United States Patent [19]

Inman

[11] 4,189,252

[45] Feb. 19, 1980

[54] UNDERSEA PLATFORM CONSTRUCTION SYSTEM

[75] Inventor: Calvin R. Inman, Bronx, N.Y.

[73] Assignee: Cygnus X-5 Company Inc., Bronx, N.Y.

[21] Appl. No.: 938,757

[22] Filed: Sep. 1, 1978

[51] Int. Cl.[2] ..... E02B 3/06; E02D 27/52; E04C 1/10

[52] U.S. Cl. ..... 405/33; 46/25; 52/286; 52/585; 52/591; 404/40; 405/111; 405/114; 405/195; 405/273

[58] Field of Search ..... 405/16, 31, 33, 34, 405/111, 114, 195, 204, 229, 273; 46/24, 25, 26; 52/284, 285, 286, 582, 585, 586, 589, 590, 591; 404/40, 41

[56] References Cited

U.S. PATENT DOCUMENTS

| | | | |
|---|---|---|---|
| 1,552,077 | 9/1925 | Palanti | 52/286 |
| 1,704,941 | 3/1929 | Hobson et al. | 405/273 |
| 1,749,303 | 3/1930 | Rutter | 405/273 |
| 1,824,990 | 9/1931 | Gilman | 405/273 |
| 2,786,301 | 3/1957 | Torricelli | 46/25 |
| 3,210,944 | 10/1965 | Svee | 405/33 |
| 3,435,576 | 4/1969 | Giannelia | 52/590 X |
| 4,004,387 | 1/1977 | Ellingson | 52/286 X |
| 4,051,621 | 10/1977 | Hogan | 46/26 |

*Primary Examiner*—David H. Corbin
*Attorney, Agent, or Firm*—Sidney W. Russell; Peter J. Georges

[57] ABSTRACT

An improved structure adapted for undersea construction is described comprising a plurality of foundation blocks, each foundation block comprising a rectahedral parallelepiped opposite faces of which are concave and convex, respectively, the opposite faces being sized and shaped to interengage matingly, such foundation blocks being interfitted into a three-dimensional array; a plurality of base pad units supporting said foundation blocks, each base pad unit comprising a rectahedral parallelepiped one face of which is convex, the opposite face of which has a plurality of protruding lugs, and the intermediate faces of which have T-shaped slots extending the length of each side, such base pad units being interfitted into a two-dimensional array by means of I-shaped keys which fit into adjacent T-shaped slots; a plurality of leg blocks supporting said base pad units, each of said leg blocks comprising a rectangular parallelepiped one face of which is convex, the opposite face of which is concave, the opposite faces being sized and shaped to interengage matingly, and the intermediate faces of which have T-shaped slots in each side, such plurality of leg blocks being interfitted into a three-dimensional array by means of the mating concave-convex faces in one direction and by means of T-shaped key assemblies which fit into adjacent T-shaped slots in the other two directions, some of said leg blocks interengaging matingly with some of said foundation blocks by means of interengaging, mating convex and concave faces. The key assemblies comprise four T-shaped keys symmetrically mounted on a planar base. The heads of said T-shaped keys extend perpendicularly to the plane of said planar base and fit into T-shaped slots in adjacent leg blocks. Specific structures of each of the components are also described.

3 Claims, 39 Drawing Figures

FIG. 27
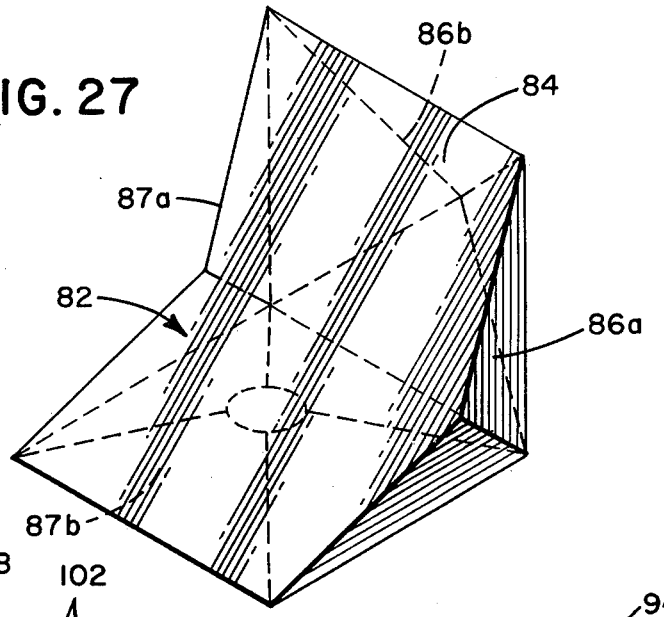
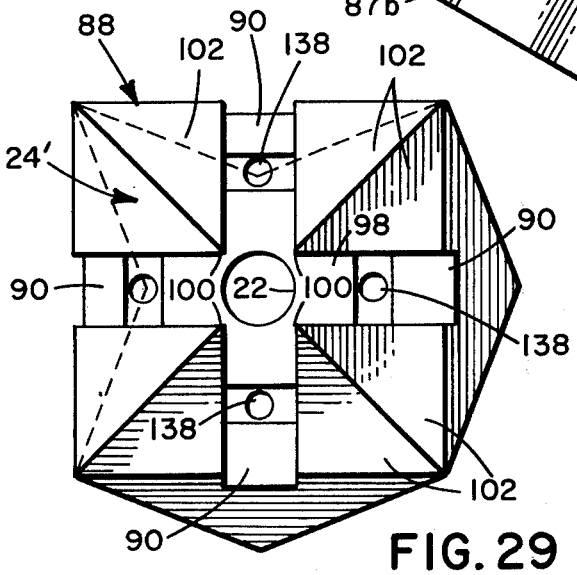
FIG. 29
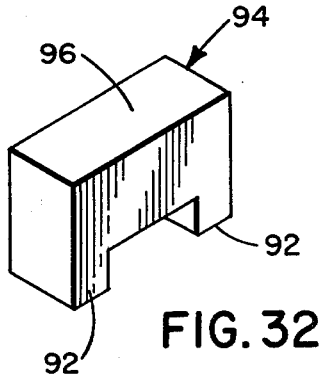
FIG. 32
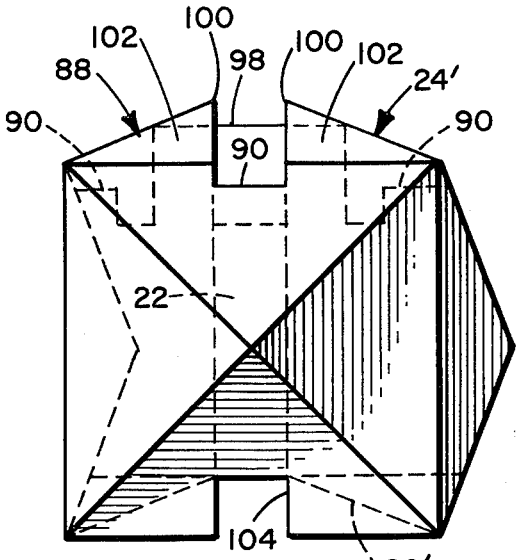
FIG. 30
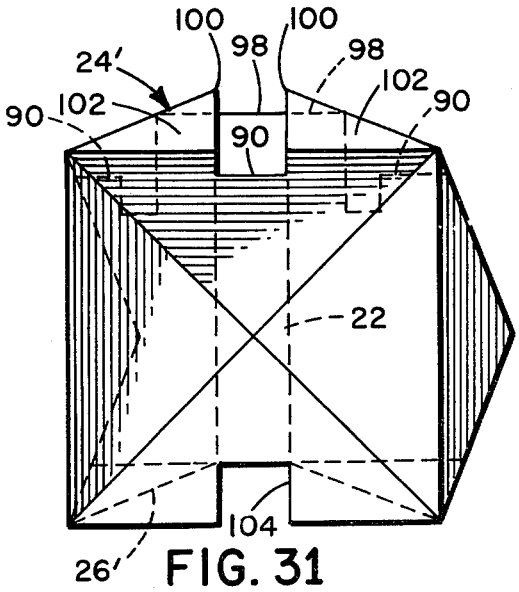
FIG. 31

UNDERSEA PLATFORM CONSTRUCTION SYSTEM

BACKGROUND OF THE INVENTION

1. Field of the Invention

The present invention is directed to an improved structure adapted for undersea construction. The structure is designed to allow for facile assembly and disassembly and is comprised of interlocking members.

2. Description of the Prior Art

The prior art is replete with various arrangements whereby structures adapted for undersea usage are constructed utilizing interlocking arrangements. Such interlock arrangements are described in U.S. Pat. No. 1,701,841, Evers, et al., Feb. 12, 1929; U.S. Pat. No. 1,703,303, Fitzgerald, Feb. 26, 1929; U.S. Pat. No. 1,770,155, Flath, July 8, 1930; U.S. Pat. No. 1,851,959, Huntoon, Mar. 29, 1932; U.S. Pat. No. 2,315,441, McDaniel, Mar. 30, 1943; U.S. Pat. No. 2,820,349, Cooper, Jan. 21, 1958; U.S. Pat. No. 2,828,613, Wilson, Apr. 1, 1958; U.S. Pat. No. 2,847,847, Moore, Aug. 19, 1958; U.S. Pat. No. 3,305,982, Steele, Feb. 28, 1967; U.S. Pat. No. 3,348,459, Harvey, Oct. 24, 1967; U.S. Pat. No. 3,379,017, Kusatake, Apr. 23, 1968; U.S. Pat. No. 3,534,518, Zabray, Oct. 20, 1970; and U.S. Pat. No. 4,041,660, Yensen, Aug. 16, 1977.

Multiple component arrangements have been employed in the prior art as illustrated in U.S. Pat. No. 3,953,979 and base members adapted to conform to variable bottom configurations are disclosed in U.S. Pat. No. 4,037,423.

The use of hollow interlocking plastic elements which are fillable with sand, rock, concrete, etc., is disclosed in U.S. Pat. No. 3,886,751.

Situs filling of support elements is disclosed in U.S. Pat. No. 4,009,580.

Structures having central openings are disclosed in U.S. Pat. No. 3,472,031.

However, an overall undersea structure capable of facile assembly and disassembly as provided by the undersea structure herein described has not been heretofore appreciated in the art of undersea platform construction. Nor has the prior art appreciated the use of varying geometrically configured construction components which allow for modification of the overall configuration of an undersea structure so as to adapt one system to multiple uses.

By utilizing the multiple component arrangement developed by applicant it is possible to provide an easily assembled and disassembled undersea structure which is capable of enlargement in all directions without disturbing the original structure.

SUMMARY OF THE INVENTION

It is therefore an object of this invention to provide an interlocking system which is adaptable as a multiple use stable underwater supported structure.

It is a further object of this invention to provide a multi-component underwater platform structure suitable for fabricating oil drilling platforms, breakwaters, piers, artificial islands, jettys, or dams on hard soil, rock or sandy bottoms.

It is yet a further object of this invention to provide an underwater structure which can be enlarged in all directions without disturbing the original structure.

It is a still further object of this invention to provide an interlocking underwater structure which is easily assembled and disassembled and which can incorporate as a component thereof sand or other heavy particulate matter available at the site of erection.

The overall undersea platform construction of this invention comprises a plurality of foundation blocks, each foundation block comprising a rectahedral parallelepiped opposite faces of which are concave and convex, respectively, the opposite faces being sized and shaped to interengage matingly, such foundation blocks being interfitted into a three-dimensional array; a plurality of base pad units supporting said foundation blocks, each base pad unit comprising a rectahedral parallelepiped one face of which is convex, the opposite face of which has a plurality of protruding lugs, and the intermediate faces of which have T-shaped slots extending the length of each side, such base pad units being interfitted into a two-dimensional array by means of I-shaped keys which fit into adjacent T-shaped slots; a plurality of leg blocks supporting said base pad units, each of said leg blocks comprising a rectangular parallelepiped one face of which is convex, the opposite face of which is concave, the opposite faces being sized and shaped to interengage matingly, and the intermediate faces of which have T-shaped slots in each side, such plurality of leg blocks being interfitted into a three-dimensional array by means of the mating concave-convex faces in one direction and by means of T-shaped key assemblies which fit into adjacent T-shaped slots in the other two directions, some of said leg blocks interengaging matingly with some of said foundation blocks by means of interengaging, mating convex and concave faces. The key assemblies comprise four T-shaped keys symmetrically mounted on a planar base. The heads of said T-shaped keys extend perpendicularly to the plane of said planar base and fit into T-shaped slots in adjacent leg blocks.

Each of the components of the platform may, depending on the structural requirements be fabricated of metal such as steel, preferably treated to avoid corrosion; concrete, generally reinforced and manufactured utilizing casting techniques; plastic, generally reinforced utilizing fibers such as fiberglass woven or nonwoven; and, other ceramic types of structural materials. The individual components of the platform may be fabricated of the same or differing materials.

The foundation block utilized in the platform comprises a rectahedral parallelepiped the opposite faces of which are concave and convex, respectively. The opposite faces are sized and shaped to interengage matingly. Such structure allows for a plurality of said foundation blocks to be interfitted into a three-dimensional array. The concave and convex faces of the foundation block may be quadrangular-pyramidal in shape. A central vertical hole is generally provided, extending from the center of one face to the center of the opposite face. Two diametrically opposed slots for the insertion of a lifting device may be provided which extend radially from the central vertical hole beginning at one face and extending part way down the length of the hole, terminating in a lifting ledge extending radially of the hole and circumferentially of the slots. Using the foregoing arrangement a T-shaped lifting device can be inserted into the hole with its ears extending into the slots. The T-shaped lifting device may then be moved axially of the hole until its ears are beneath the lifting ledge. Thereafter, the T-shaped lifting device can be rotated circumferentially of the hole until its ears have passed beyond the slots into position to engage said lifting ledge to thereby facilitate the installation of the foundation block. The foundation block may have a detent means on the lifting ledge thereof for temporarily engaging the lifting device, preventing unintended circumferential movement of the lifting device during installation of the foundation block. The foundation block is optionally hollow and is provided with at least one filling port, whereby the block can be filled with ballast at the construction location. The filling port may be covered with a removable plate, whereby the block can be maintained watertight and bouyant until the plate is removed. The configuration of the foundation block best adapted for underwater platform construction is one wherein the three concave sides are adjacent to one another in a L-shaped pattern and the three convex sides are adjacent to one another in an interlocking L-shaped pattern. The base pad unit comprises a rectahedral parallelepiped. One face of the parallelepiped is convex, and the opposite face has a plurality of protruding lugs sized and shaped to cooperate with corresponding sockets on other structural elements. The intermediate faces of the parallelepiped have T-shaped slots extending the length of each side, whereby a plurality of said base pad units can be interfitted into a two-dimensional array by means of I-shaped keys which fit into adjacent T-shaped slots. The convex face of the base pad is preferably quadrangular-pyramidal in shape. Most preferably a central vertical hole is provided extending from the center of the convex face to the center of the opposite face of said base pad, and the lugs are rectahedral parallelepipedal in shape.

The leg block comprises a rectahedral parallelepiped. One face of the leg block is convex, the opposite face is concave. The opposite faces are sized and shaped to interengage matingly, and the intermediate faces have T-shaped slots in each side, whereby a plurality of said leg blocks can be interfitted into a three-dimensional array by means of the mating concave-convex faces in one direction and by means of T-shaped keys which fit into adjacent T-shaped slots in the other two directions. The convex face of the leg block is preferably formed by a centrally positioned rectahedral parallelepipedal lug, and the concave face is formed by a cooperating centrally positioned rectahedral parallelepipedal recess.

Also a part of my invention is a key assembly for interconnecting a plurality of structural elements. The key assembly comprises four T-shaped keys symmetrically mounted on a planar base, the heads of the T-shaped keys extend perpendicularly to the plane of said planar base.

The planar base is preferably a rectangular ring with the T-shaped keys extending radially from each vertex of the ring. The rectangular ring is preferably equalateral.

Yet another aspect of this invention relates to a structural block comprising an irregular polyhedron in the shape of half a rectahedral parallelepiped. The rectahedral parallelepiped is divided along a plane extending from one edge of the rectahedral parallelepiped to the diagonally opposite edge; two of the three remaining faces of the rectahedral parallelepiped are either concave or convex and the third of the remaining faces of the rectahedral parallelepiped is the opposite of the first two faces. The concave and convex faces are sized and shaped to interfit with a plurality of structural blocks in the shape of correspondingly shaped rectahedral parallelepipeds. The concave and convex faces of the structural block are preferably quadrangular-pyramidal in shape.

The foregoing structural block is adapted to provide a substantially smooth planar surface on an overall structure comprising a plurality of first blocks each of which comprises a rectahedral parallelepiped opposite faces of which are concave and convex, respectively, the opposite faces of which are sized and shaped to interengage matingly, said first blocks being interfitted into a three-dimensional array having at least one face which slopes uniformly in one direction by reason of the outside one of said first blocks in each layer of the array being set back by the width of one of said first blocks from the outside one of said first blocks in the previous layers; and a plurality of second blocks each of which is an irregular polyhedron as heretofor described in the shape of half of one of said first blocks, the first blocks being divided along a plane extending from one edge of the first blocks to the diagonally opposite edge, the second blocks being interfitted with said first blocks such that the remaining concave and convex faces on the second blocks matingly interengage with the outside ones of the first blocks on the faces sloping uniformly in one direction. The planar faces on the second blocks thereby form a planar face for said structure. Preferably the concave and convex faces on said first and second blocks are quadrangular-pyramidal in shape.

The most detailed and specific aspects of this invention pertaining to the foundation block and leg block are related below.

In the rectahedral parallelepiped foundation block wherein opposite faces are concave and convex in shape and a central vertical hole is provided, most preferably the faces through which the central vertical hole extends are provided with notches on each of their four edges. The notches are sized and shaped to receive interlocking keys the exterior surfaces of which lie in a common plane flush with the outermost points of said block. In this manner a common plane is provided which may be used as a support for a planar surface facing the interlocking foundation blocks. The concave and convex faces of the foundation block are preferably cruciform in shape with the legs of the crosses perpendicular to the intermediate sides of the rectahedral parallelepiped. The concave and convex faces also preferably slope away from the inner vertices of the cross to the peripheral edges of the intermediate sides of the rectahedral parallelepiped. Most preferably, the sloping surfaces are bi-planar, each planar surface being in the form of a triangle one vertex of which is an inner vertex of the cross, one vertex of which is a corner of the rectahedral parallelepiped, and one vertex of which is the vertex where the adjacent arm of the cross meets an intermediate face of the rectahedral parallelepiped.

In the rectahedral parallelepiped leg block one face of which is convex and the opposite face of which is concave it is most preferrd that the concave and convex faces be cruciform in shape with the legs of the crosses perpendicular to the intermediate sides of the rectahedral parallelepiped. The concave and convex faces preferably slope away from the inner vertices of the cross to the peripheral edges of the intermediate sides of the rectahedral parallelepiped. The sloping surfaces are most preferably bi-planar, each planar surface being in the form of a triangle one vertex of which is an inner vertex of the parallelepiped, and one vertex of which is the vertex where the adjacent arm of the cross meets an intermediate face of the rectahedral parallelepiped.

As noted heretofore the intermediate faces of the leg blocks have T-shaped slots in each side whereby a plurality of leg blocks can be interfitted by means of T-shaped keys which fit into the T-shaped slots. The T-shaped slots may extend the length of each intermediate side or in the most preferred embodiment the T-shaped slots are centrally positioned and upwardly open so as to accept insertion of keys vertically.

BRIEF DESCRIPTION OF THE DRAWINGS

FIG. 27 is a first perspective view looking toward the inclined plane surface of the front face 84 of the half-cube unit shown in FIG. 23.

FIG. 29 is a top plan view of a modified foundation cube unit.

FIG. 30 is a front elevational view of the foundation cube unit shown in FIG. 29.

FIG. 31 is a side elevational view of the foundation cube unit shown in FIG. 29.

FIG. 32 is a perspective view of a key designed for use with the foundation cube unit shown in FIGS. 29–31.

DETAILED DESCRIPTION OF THE PRESENTLY PREFERRED EMBODIMENTS

Figure 16:
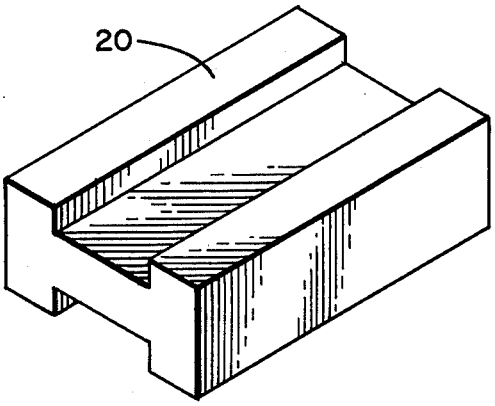
FIG. 16 is a perspective view of an I-shaped key used to connect adjacent base pads.
Figure 20:
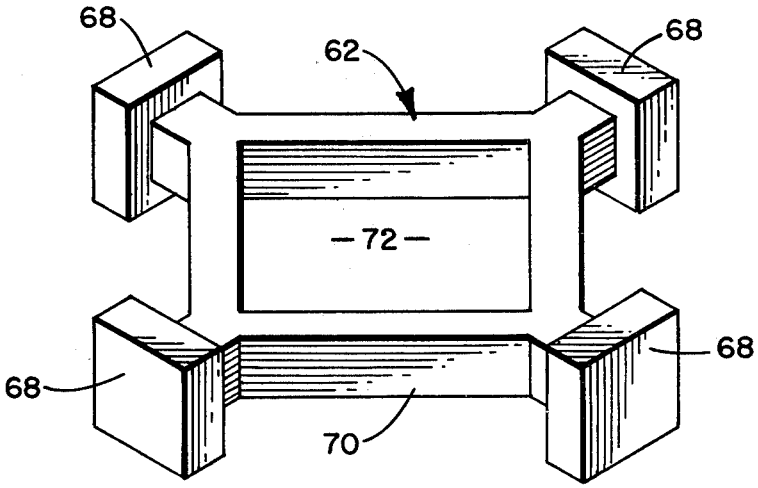
FIG. 20 is a perspective view of a key for interconnecting a group of four leg blocks.

The overall structure shown in FIGS. 1–5 comprises subpads 10 underlying columnar legs 12, base pad units 14, and foundation cube units 16. The columnar legs 12 comprise a plurality of leg blocks 18 stacked on top of one another and held together with interlocking keys 62, one of which is shown in FIG. 20. The base pad units 14 are also interlocked with keys 20, one of which is shown in FIG. 16.

FIGS. 1–5 will be returned to subsequently, after the individual components have been described in detail.

The Foundation Cube Units 16

Figure 1:
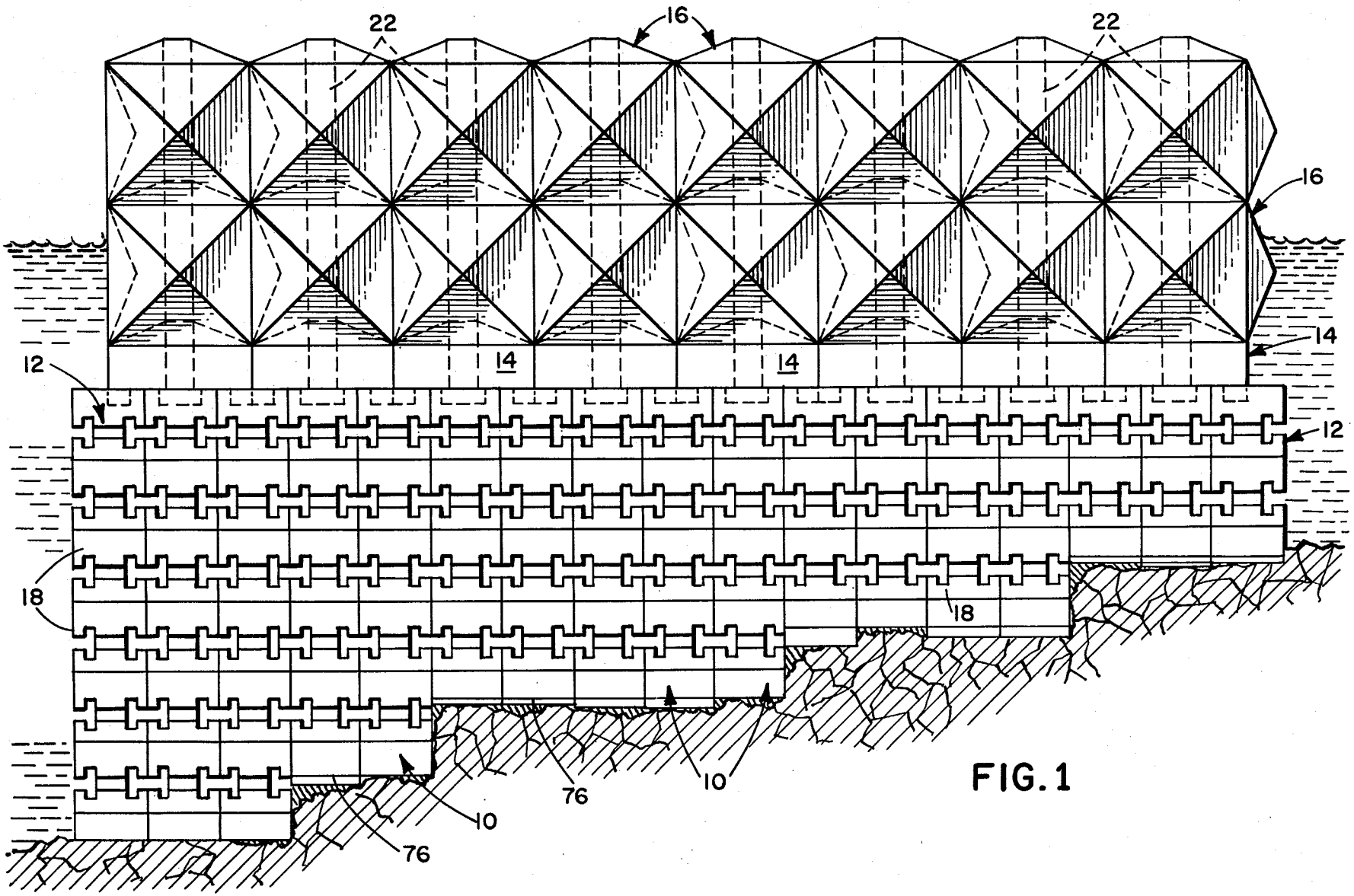
FIG. 1 is a side elevational view illustrating the entire structure with the interlocking components in place.

The foundation cube units 16 shown in FIGS. 6–11 comprise rectahedral parallelepipeds the opposite faces of which are concave and convex, respectively. The corresponding faces may be termed "pyramidal concavities or convexities." As best seen in FIG. 1, the opposite faces of the units 16 are sized and shaped to interengage matingly, allowing a plurality of the units 16 to be interfitted into a three-dimensional array. To accomplish this, the three concave sides are adjacent to one another in an L-shaped pattern, and the three convex sides are adjacent to one another in an interlocking L-shaped pattern. Preferably, the concave and convex faces are quadrangular-pyramidal in shape, although other suitable shapes may be used.

A central vertical hole 22 is provided extending from the center of one face 24 to the center of the opposite face 26. Two diametrically opposed slots 28 are provided extending radially from the central vertical hole 22 beginning at the face 24 and extending part way down the length of the hole 22. The slots 28 terminate in a lifting ledge 30 extending radially of the hole 22 and circumferentially of the slots 28. The hole 22, the slots 28, and the lifting ledge 30 permit a T-shaped lifting device (not shown) to be inserted into the hole 22 with its ears extending into slots 28, moved axially of the hole 22 until its ears are beneath the lifting ledge 30, rotated cifcumferentially of the hole 22 until its ears have passed the slots 28 into position to engage the lifting ledge 30, and used to install the unit 16. Preferably the unit 16 further comprises a detent means on the lifting device during installation of the foundation unit 16. As shown, the detent means can conveniently comprise a downwardly open notch 32 in the lifting ledge 30 sized and shaped to receive the ears of the T-shaped lifting device.

Figure 9:
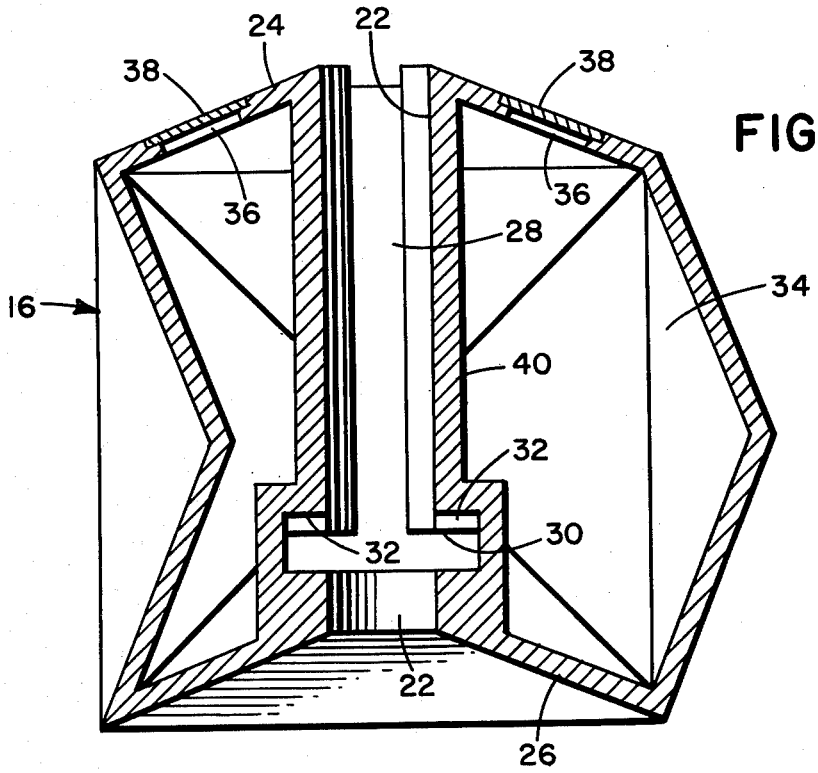
FIG. 9 is a vertical sectional view taken along the line 9—9 in FIG. 7.
Figure 10:
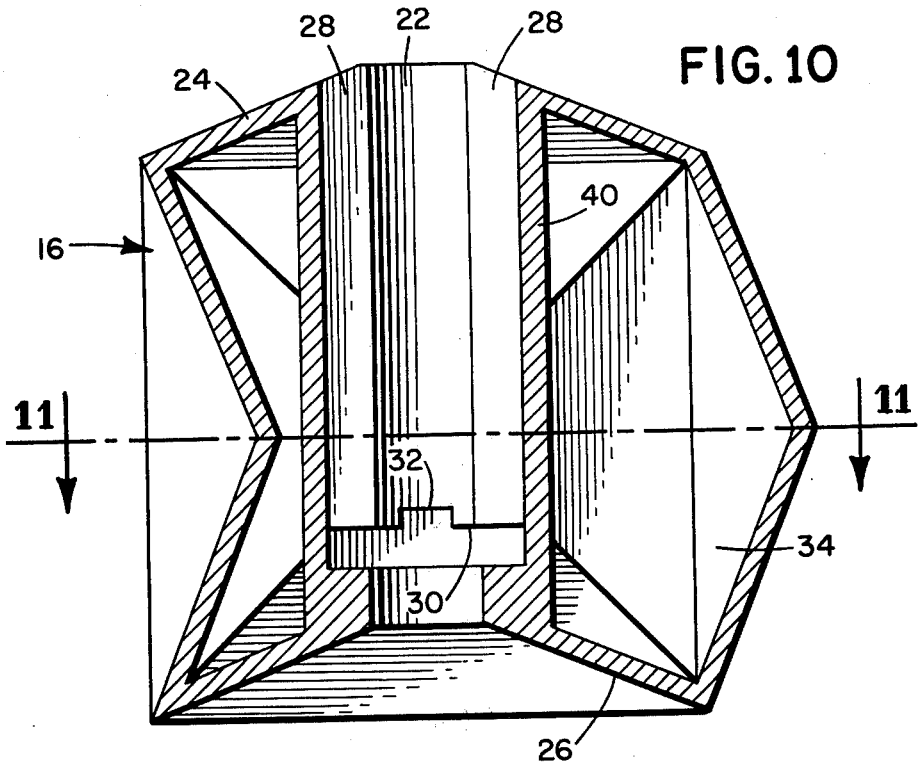
FIG. 10 is a vertical sectional view taken along the line 10—10 in FIG. 7.
Figure 11:
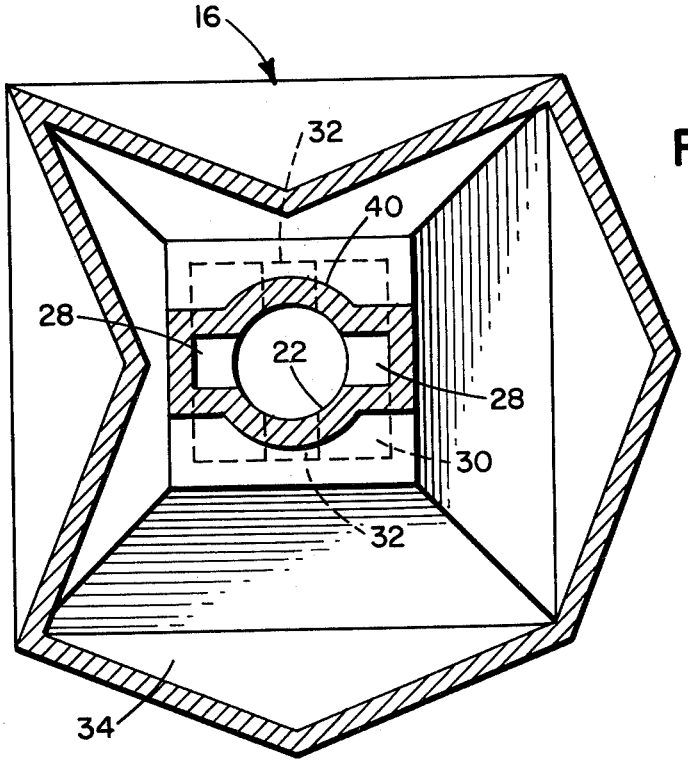
FIG. 11 is a horizontal sectional view taken along the line 11—11 in FIG. 10.
Figure 12:
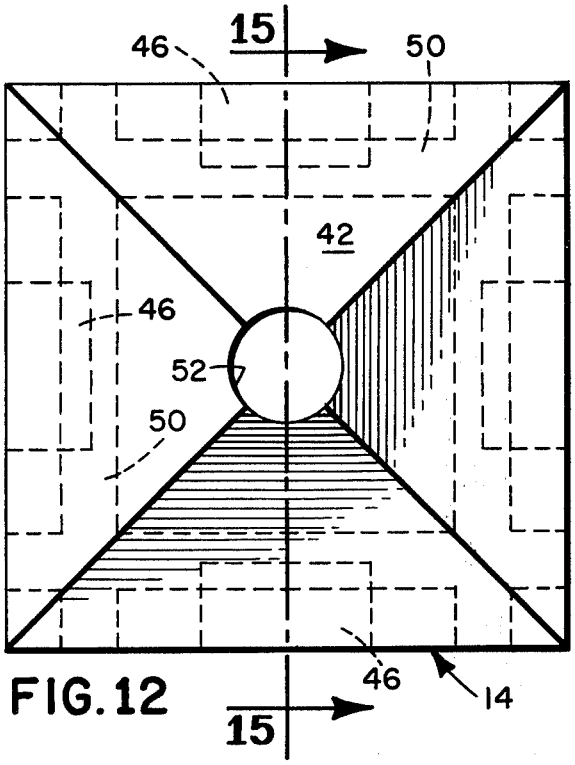
FIG. 12 is a top plan view of a base pad unit.
Figure 13:
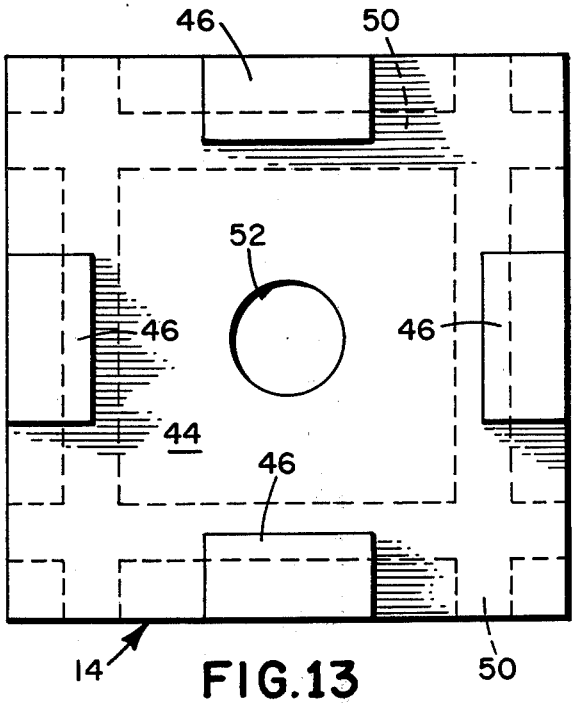
FIG. 13 is a bottom plan view of the base pad unit shown in FIG. 12.
Figure 14:
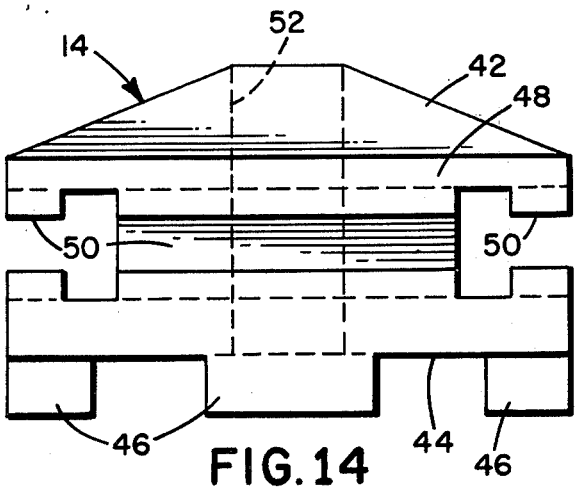
FIG. 14 is a side view of the base pad unit shown in FIG. 12.
Figure 15:
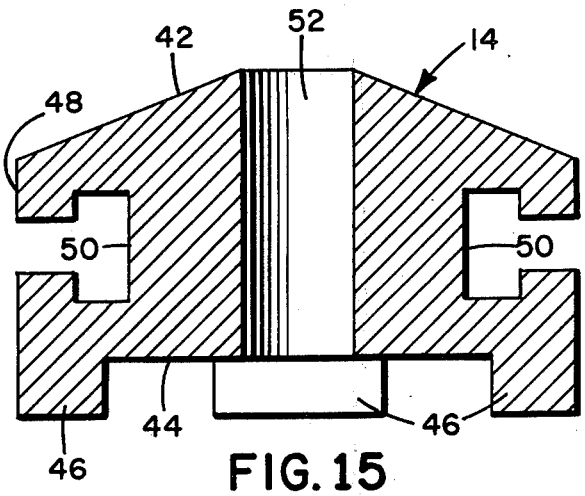
FIG. 15 is a vertical sectional view taken along the line 15—15 in FIG. 12.

In its preferred embodiment, the unit 16 is hollow at 34 and is provided with at least one filling port 36 which can be used to fill the block with ballast at the construction location. As best seen in FIG. 9, the filling ports 36 are covered with removable plates 38 so that the unit 16 can be maintained water-tight and bouyant until the plates 38 are removed. In this embodiment, which has both a central vertical hole 22 and a hollow 34, an internal wall 40 defines the hole 22 and extends from the face 24 to the face 26.

The Base Pad Unit 14

The base pad unit 14 shown in FIGS. 12–15 comprises a rectahedral parallelepiped one face 42 of which is convex, the opposite face 44 is planar and has a plurality of protruding lugs 46 sized and shaped to cooperate with corresponding sockets on the leg blocks 18. The intermediate vertical faces 48 are intersected by T-shaped slots 50 extending the length of each side. The T-shaped slots 50 are sized and shaped so that a plurality of the base pad units 14 may be interconnected into a two dimensional array by means of I-shaped keys 20, one of which is shown in FIG. 16. The face 42 is preferably quadrangular-pryamidal in shape, and the lugs 46 are preferably rectahedral parallelepipedal in shape. A central vertical hole 52, which in use aligns with the central vertical hole 22 in one of the foundation cube units 16, is provided.

The Leg Blocks 18

Figure 17:
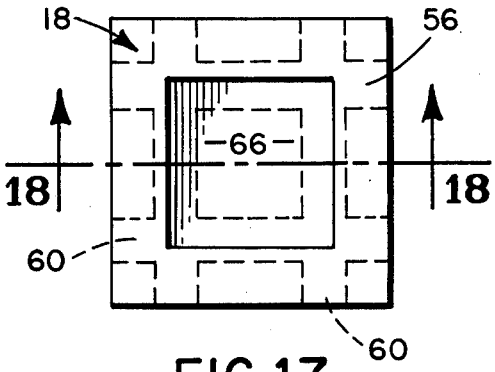
FIG. 17 is a top plan view of a leg block.
Figure 19:
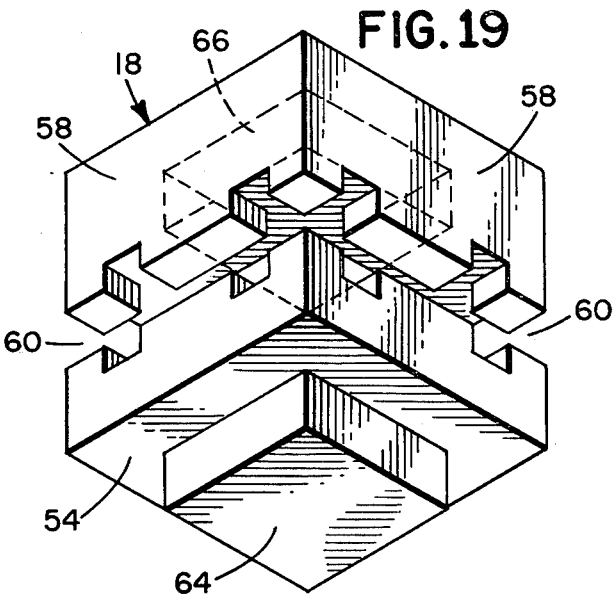
FIG. 19 is a perspective view of the leg block shown in FIG. 17.
Figure 18:
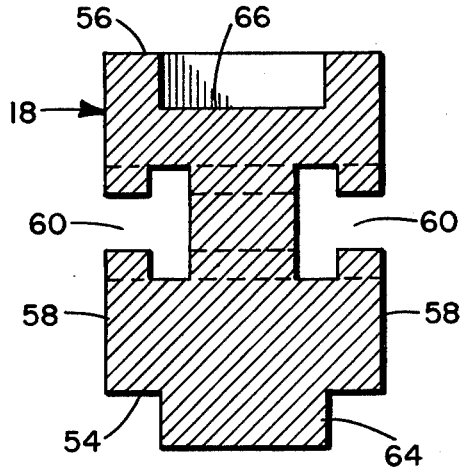
FIG. 18 is a vertical sectional view taken along the line 18—18 in FIG. 17.

The leg blocks 18 shown in FIGS. 17–19 comprises a rectahedral parallelepiped one face 54 of which is convex, the opposite face 56 of which is concave, and the intermediate vertical faces 58 of which have T-shaped slots 60 in each side. The horizontal faces 54 and 56 are sized and shaped to interengage matingly, and the slots 60 are sized and shaped so that a plurality of the leg blocks 18 can be linked into a two-dimensional array by means of key assemblies 62 such as the one shown in FIG. 20 and described hereinafter. Accordingly, a plurality of the leg blocks 18 can be interfitted into a three-dimensional array by means of the mating concave-convex faces 54, 56 in one direction and key assemblies 62 in the other two directions.

In the illustrated embodiment the convex face 54 is formed by a centrally positioned rectahedral parallelepipedal lug 64, and the concave face 56 is formed by a cooperating centrally positioned rectahedral parallelepipedal recess 66. However, other appropriate mating shapes could be used, including the quadrangular-pyramidal shape of the foundation cube unit 16.

The key assembly 62 as shown in FIG. 20 comprises four T-shaped keys 68 symmetrically mounted on a planar base 70 with the heads of the T-shaped keys 68 extending perpendicularly to the plane of the planar base 70. The planar base 70 is preferably formed as a rectangular ring defining a central opening 72, and one of the T-shaped keys 68 extends radially from each vertex of the ring. If the leg blocks 18 are square in cross-section, then the rectangular ring of the key assemblies 62 is likewise equalateral in cross-section.

The Subpads 10

Figure 21:
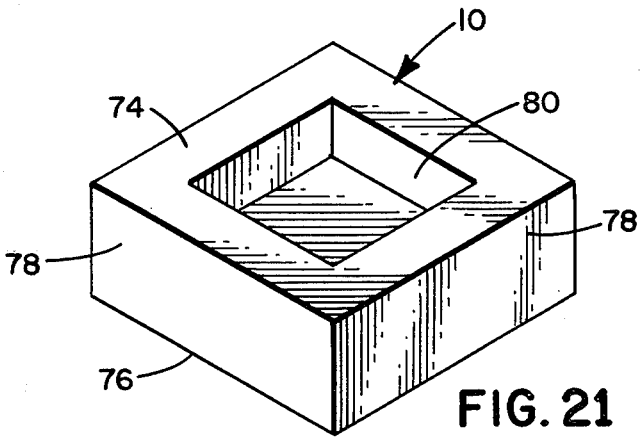
FIG. 21 is a perspective view of a subpad 10.

The subpad 10 shown in FIG. 21 comprises a rectahedral parallelepiped one face 74 of which is concave, the opposite face 76 of which is planar, and the intermediate faces 78 of which are planar. The concave face 74 is sized and shaped to interengage matingly the concave face 54 of the lowermost leg block 18.

Shims 11 of various thicknesses may be provided under certain subpads, as seen in FIG. 1, in order to ensure a good footing. Thus, in the illustrated embodiment that concave face 74 is formed by a centrally positioned rectahedral parallelepipedal recess 80 sized and positioned to cooperate with the lug 64 on the lowermost leg block 18.

The Basic Overall Structure

Now that the individual components of the basic structure have been described in detail, it is appropriate to return to FIGS. 1–5.

Figure 2:
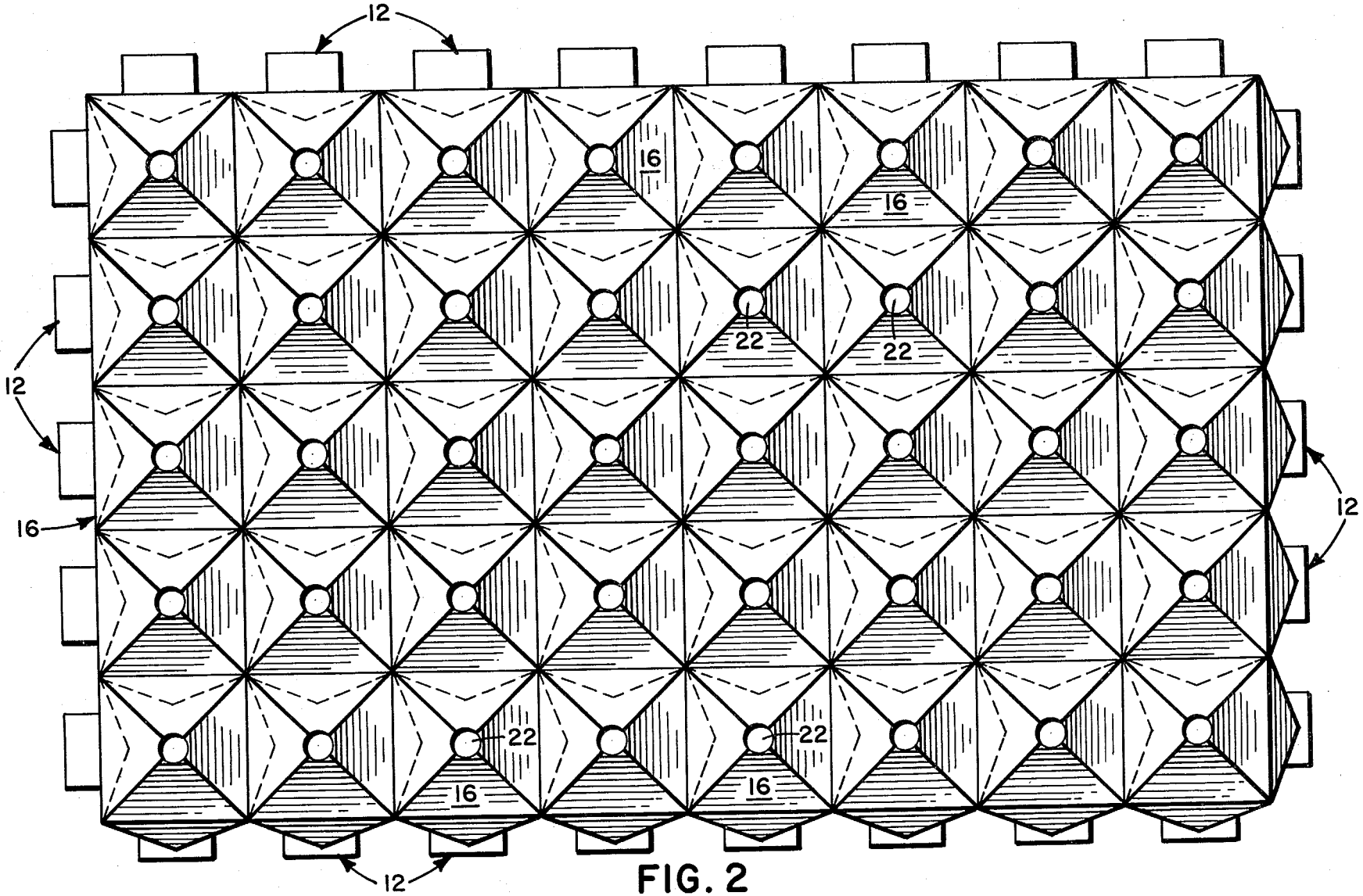
FIG. 2 is a top plan view of the structure seen in FIG. 1.
Figure 3:
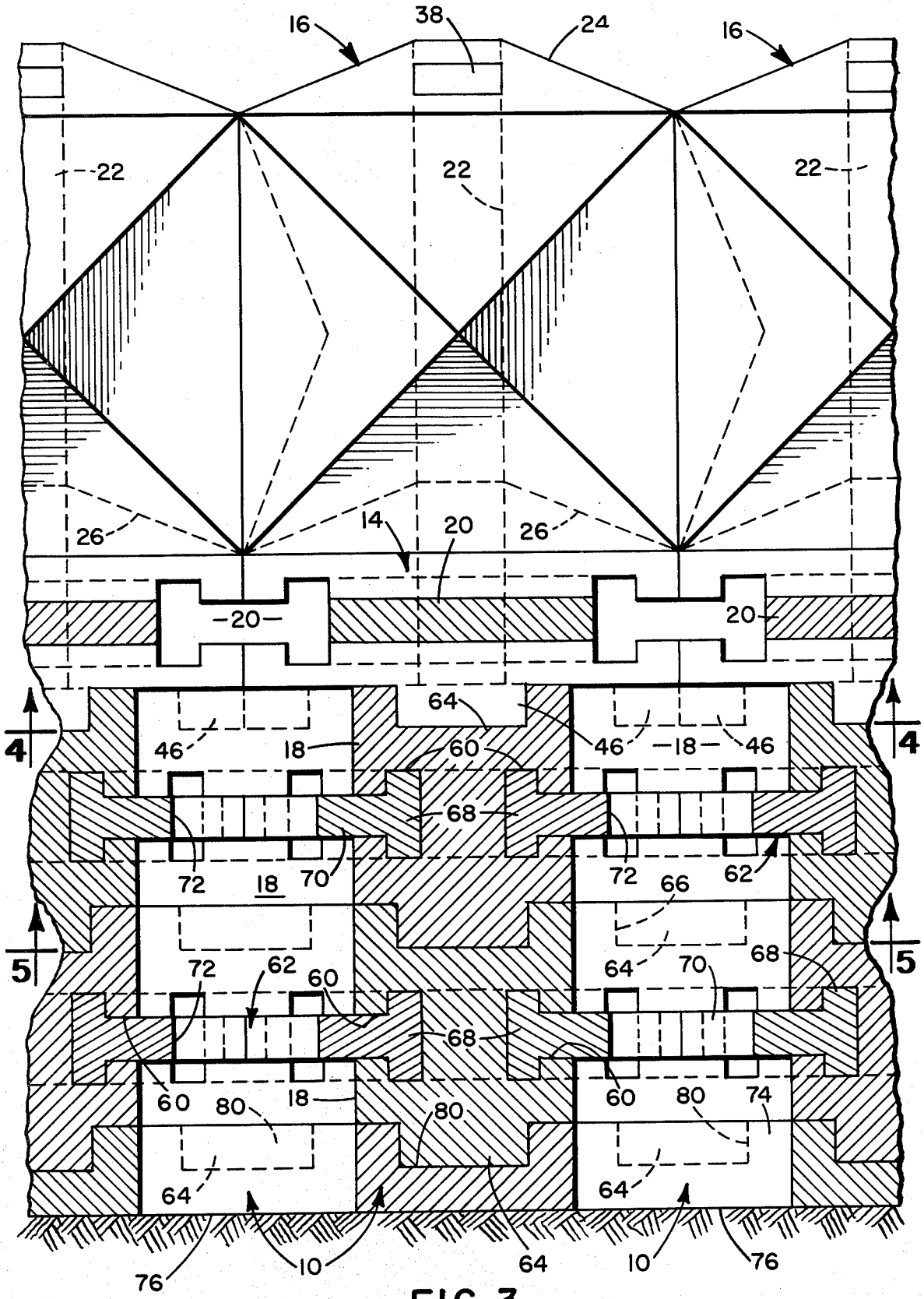
FIG. 3 is a sectional view taken along line 3—3 of FIG. 5.

FIG. 1 is a side elevational view illustrating the entire structure with the interlocking component in place. FIG. 2 is a plan view of the structure seen in FIG. 1. It shows the intermeshing convex-concave side of the units 16 and the central vertical hole 22 through the cube units 16. The central vertical hole 22 in the cube units 16 is aligned with the central vertical hole 52 in the base pad units 14 and the central opening 72 of the key assemblies 62. Accordingly, a drill rod string or the like can be dropped down through the aligned holes to the ocean floor. This is clearly illustrated in FIG. 3, which is basically an enlarged view along the line 3—3 in FIG. 5. However, only a few leg blocks 18 have been shown in FIG. 5 in order to simplify the illustration. As shown therein, the downward facing concave faces 26 of the cube units 16 mate vertically with the upward facing convex faces 42 of the base pad units 14; the concave-convex faces of the cube units 16 mate horizontally; the keys 20 interengage the base pad units 14 horizontally; one protruding lug 46 on each of adjacent base pad unit 14 is received in the recess 66 of the uppermost leg block 18; the downward facing convex face 54 of the leg blocks 18 mates vertically with the upward facing concave faces 56 of the next lower leg block 18; horizontally adjacent leg blocks 18 are interconnected by key assemblies 62; and the downward facing convex face 54 of the lowermost leg block 18 in each columnar leg 12 mates vertically with the upward facing concave face 80 of a subpad 10.

Figure 4:
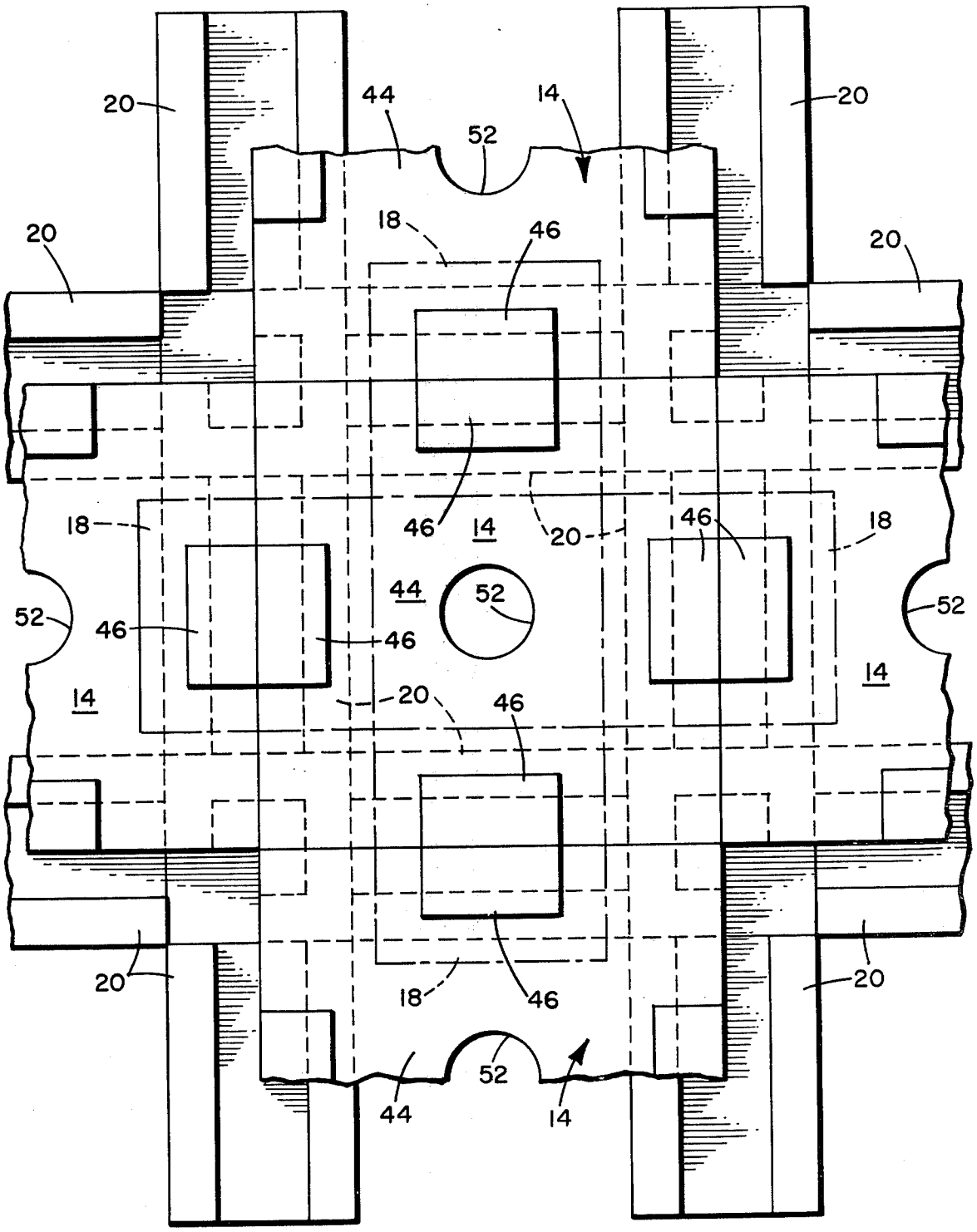
FIG. 4 is a bottom plan view taken along the line 4—4 in FIG. 3.

FIG. 4 shows in bottom plan view an assembly of several base pad units 14. The relative alignment of the lugs 46 on adjacent base pad units 14 should be particularly noted, as well as the fact that two adjacent lugs 46 together form a proturberance which just fills the recess 66 of the uppermost leg block 18 (above the plane of FIG. 4). It should also be noted that the engagement of each uppermost leg block 18 (shown in dot-dash lines) with protruding lugs 46 from two different base pad units 14 serves to reinforce the horizontal integrity of each columnar leg 12. Finally, it should again be noted that the central holes 52 in the base pad unit 14 align with the central holes 22 in the foundation units 16, which are beneath the plane of FIG. 4.

Figure 5:
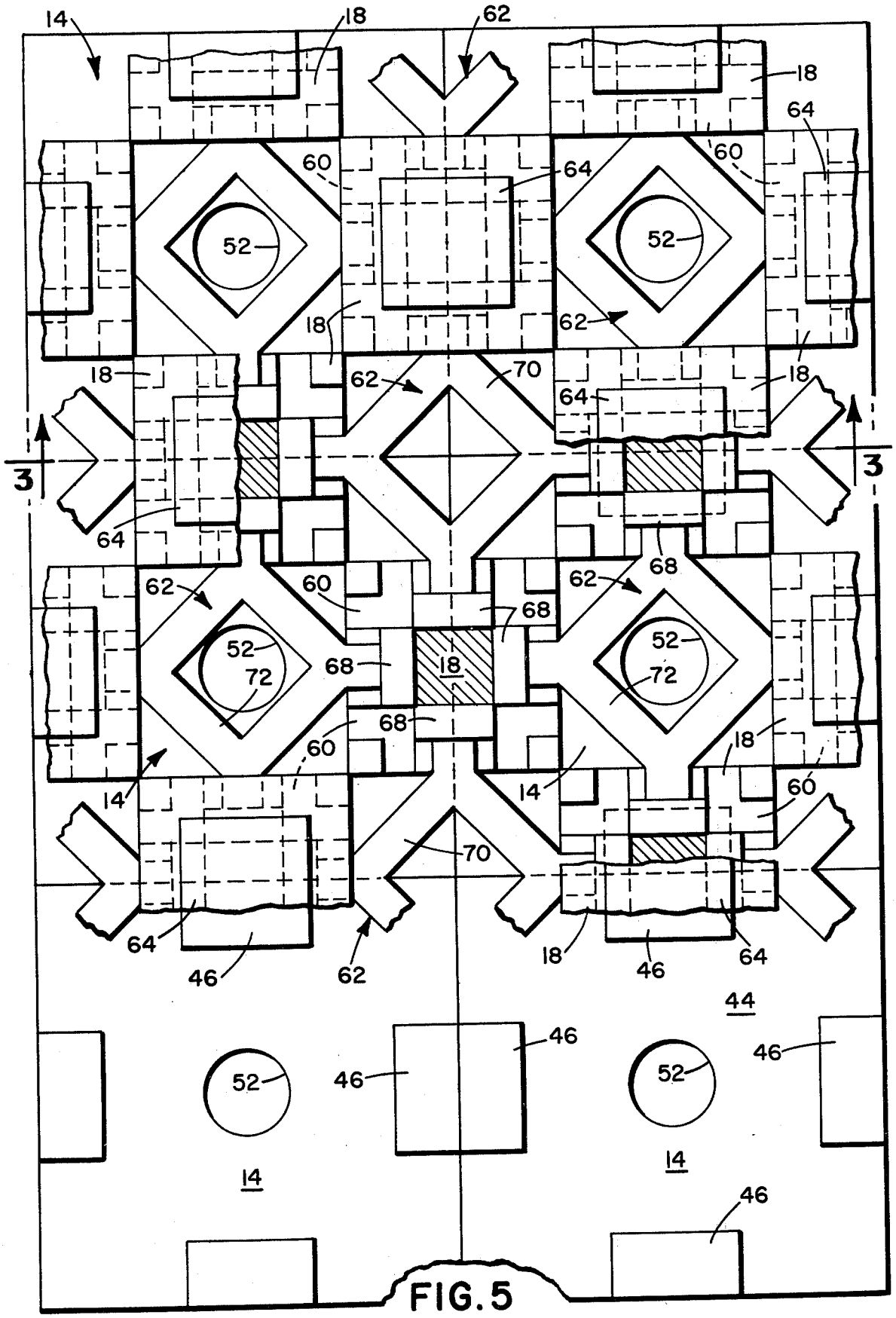
FIG. 5 is a bottom plan view taken along the line 5—5 in FIG. 3.
Figure 6:
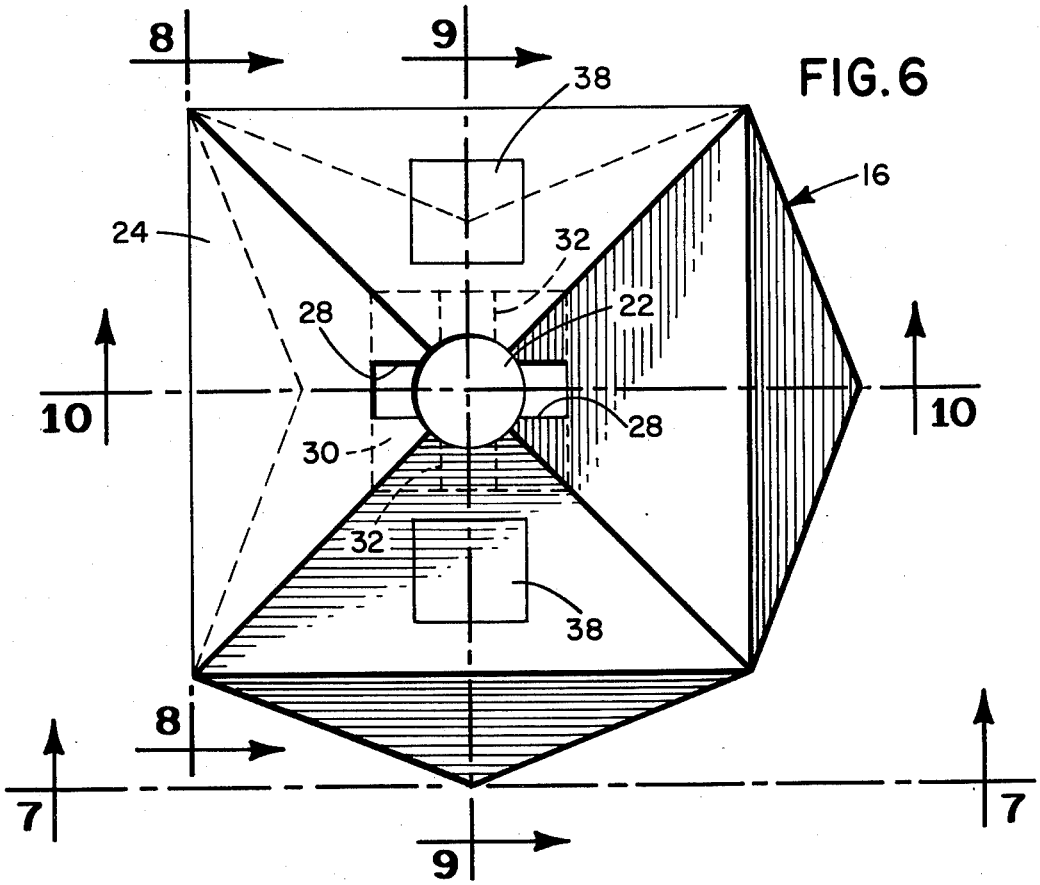
FIG. 6 is a top plan view of a foundation block.
Figure 7:
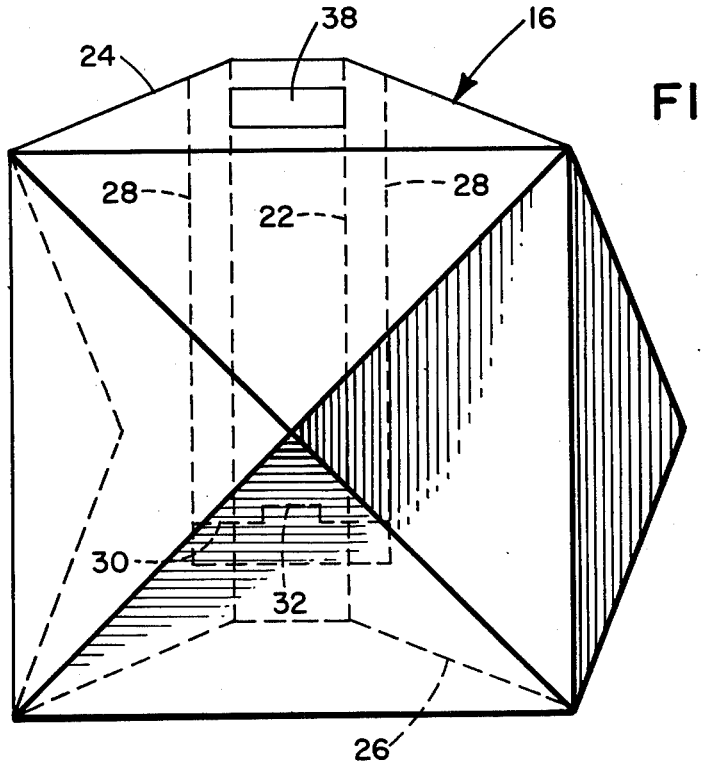
FIG. 7 is a side elevation taken along the line 7—7 in FIG. 6.
Figure 8:
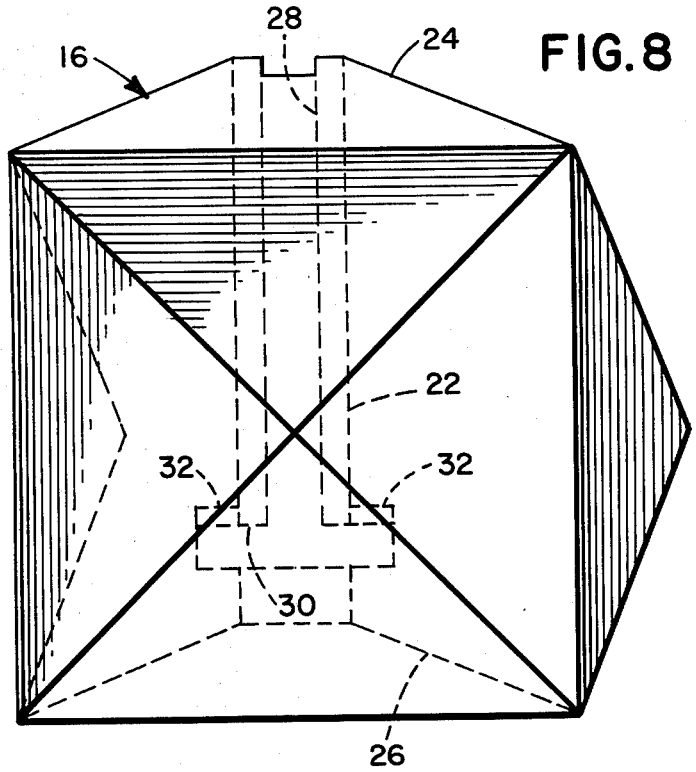
FIG. 8 is a side elevation taken along the line 8—8 in FIG. 7.

FIG. 5 is a bottom plan view of a group of leg blocks 18 held together horizontally by key assemblies 62. The engagement of the T-shaped keys 68 on each key assembly 62 with the slots 60 in each leg block 18 should be particularly noted. Also, it should be noted that the base pad units 14 are visible around the edges of the key assemblies 62 and the central hole 52 in the base pad units 14 is visible through the central opening 72 in the key assemblies 62.

The Dam Variant

Figure 22:
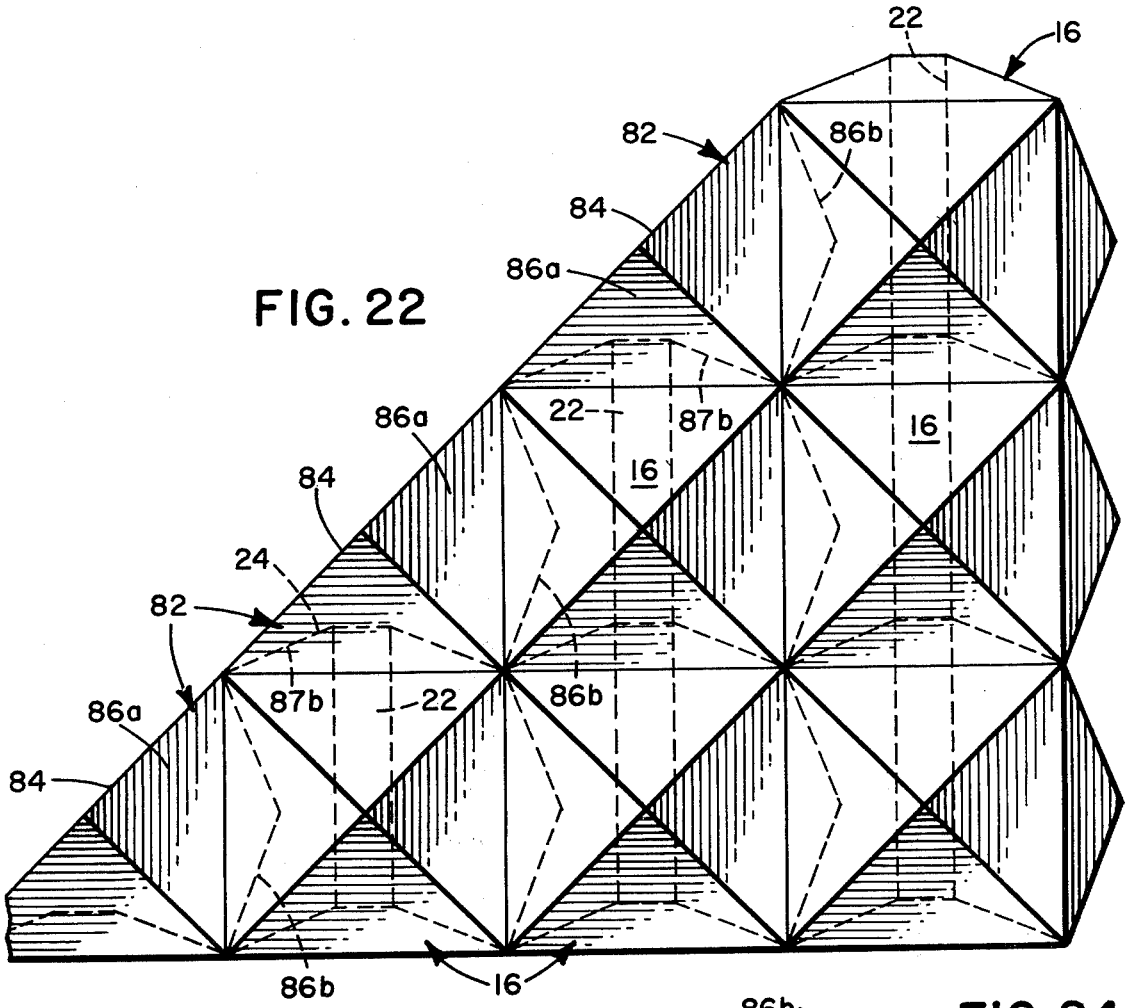
FIG. 22 is a side view of a structure such as might be used for a dam.
Figure 23:
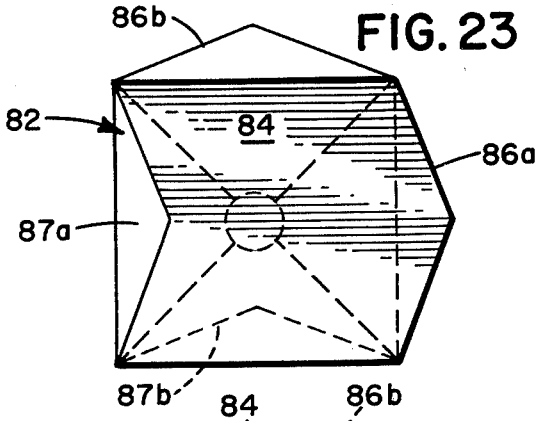
FIG. 23 is a top plan view of a half-cube unit used in FIG. 22.
Figure 24:
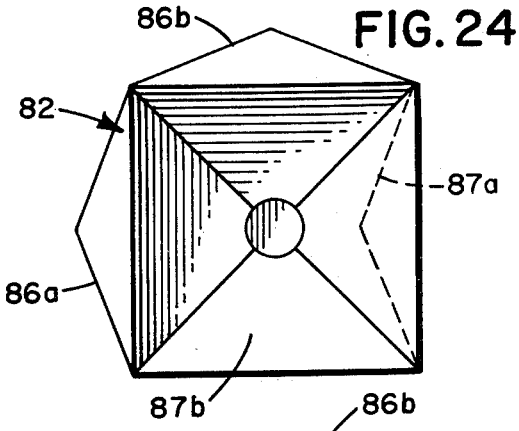
FIG. 24 is a bottom plan view of the half-cube unit shown in FIG. 23.
Figure 25:
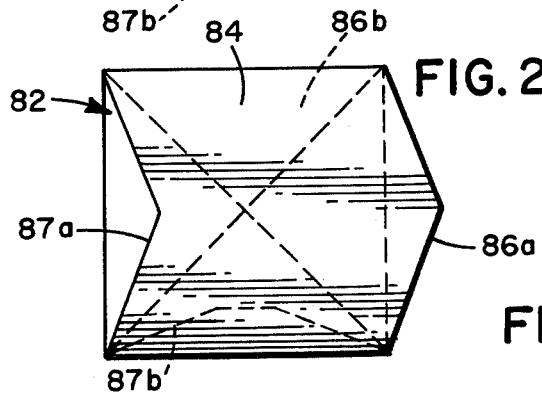
FIG. 25 is a front elevational view of the half-cube unit shown in FIG. 23.
Figure 26:
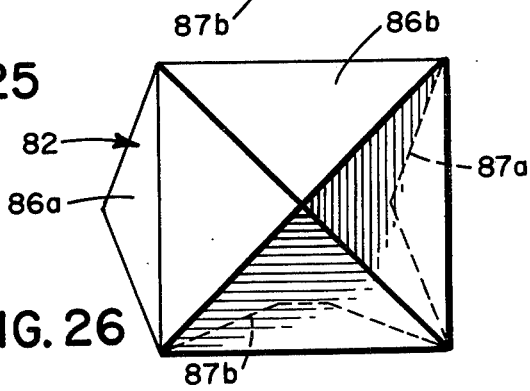
FIG. 26 is a rear elevational view of the half-cube unit shown in FIG. 23.

The foundation cube units 16 may be used in structures other than undersea platforms. For instance, they can be used in the construction of a dam, shown in FIG. 22. However, since it is ordinarily desirable to provide a substantially smooth downstream face on a dam, in this use the cube units 16 will ordinarily be used in conjunction with a plurality of half-cube units 82.

As shown in FIGS. 23–28, the half-cube units 82 comprise an irregular polyhedron in the shape of half a rectahedral parallelepiped, the rectahedral parallelepiped being divided along a plane 84 extending from one edge of the rectahedral parallelepiped to the diagonally opposite edge. Two of the four remaining faces, 86*a* and 86*b* of the rectahedral parallelepiped are convex, and two (87*a*, 87*b*) are concave. Thus, the concave/convex faces of the units 82 form pyramidal concavities or convexities which are sized and shaped to interfit with a plurality of structural blocks in the shape of correspondingly shaped rectahedral parallelepipeds—i.e., the units 16 and with adjacent half-cube units. In particular, the convex face 86*b* is preferably quadrangular-pyramidal in shape to match the concave face of the units 16, and the concave bottom face 87*b* matches the convex upper face 24 of units 16.

Alternative Cube Unit 88

Figure 34:
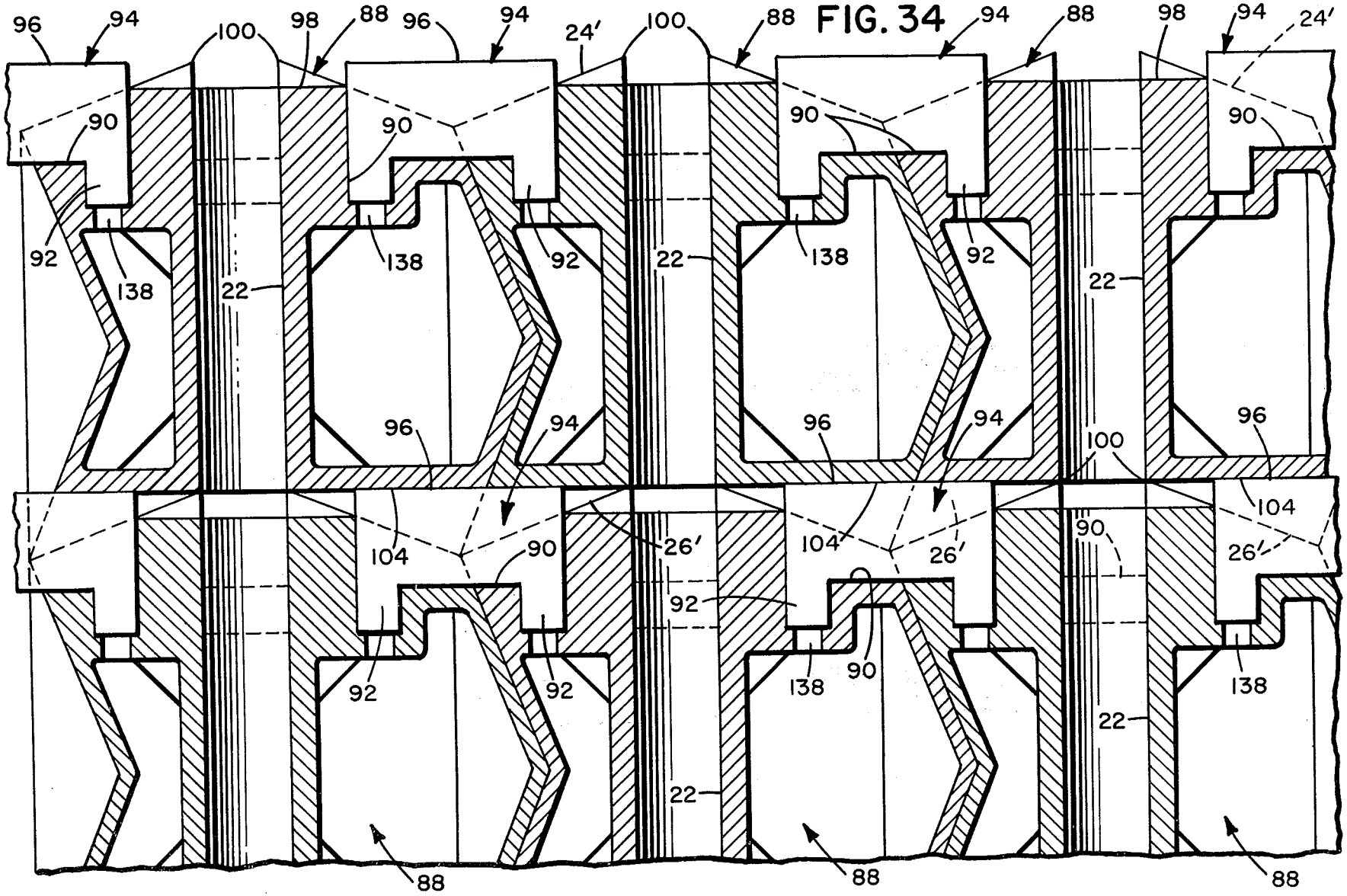
FIG. 34 is a vertical sectional view taken along line 34—34 of FIG. 33.

A foundation cube unit 88 which may be used as an alternative to the foundation cube unit 16 is shown in FIGS. 29–31. In this alternative, the faces 24' and 26' through which the central vertical hole 22 extends are provided with notches 90 on each of their four edges. Each of the notches 90 is sized and shaped to receive one leg 92 of a U-shaped key 94 (shown in FIG. 32). The U-shaped key 94 is sized and shaped so that the top surface 96 lies in a plane flush with the uppermost points 100 of the units 88, as best seen in FIG. 34. The common plane formed by a group may be used as a support for a planar surface resting on the innerlocking foundation units 88.

Preferably the faces 24' and 26' of each unit 88 are cruciform in shape with the legs 98 of the cross perpendicular to the intermediate sizes of the rectahedral parallelepiped. Additionally, the faces 24' and 26' slope away from the inner vertices 100 of the cross to the peripheral edges of the intermediate sides of the rectahedral parallelepiped, and the sloping surfaces 102 are bi-planar. Each planar surface is in the form of a triangle one vertex of which is an inner vertex 100 of the cross, one vertex of which is a corner of the rectahedral parallelepiped, and one vertex of which is the vertex where the adjacent arm of the cross meets an intermediate face of the rectahedral parallelepiped.

Notches 104 are formed in the botton concave face 26' to match the convex top of the mating lower cube 88 and keys 94 as seen in FIG. 34. The bottom face 26' also mates with the top convex face 142 of modified foundation pad 114 shown in FIGS. 35 and 36.

Ballast filling ports 138 are provided in the bottom of notches 90.

Construction Employing the Alternative Cube Unit 88

Figure 33:
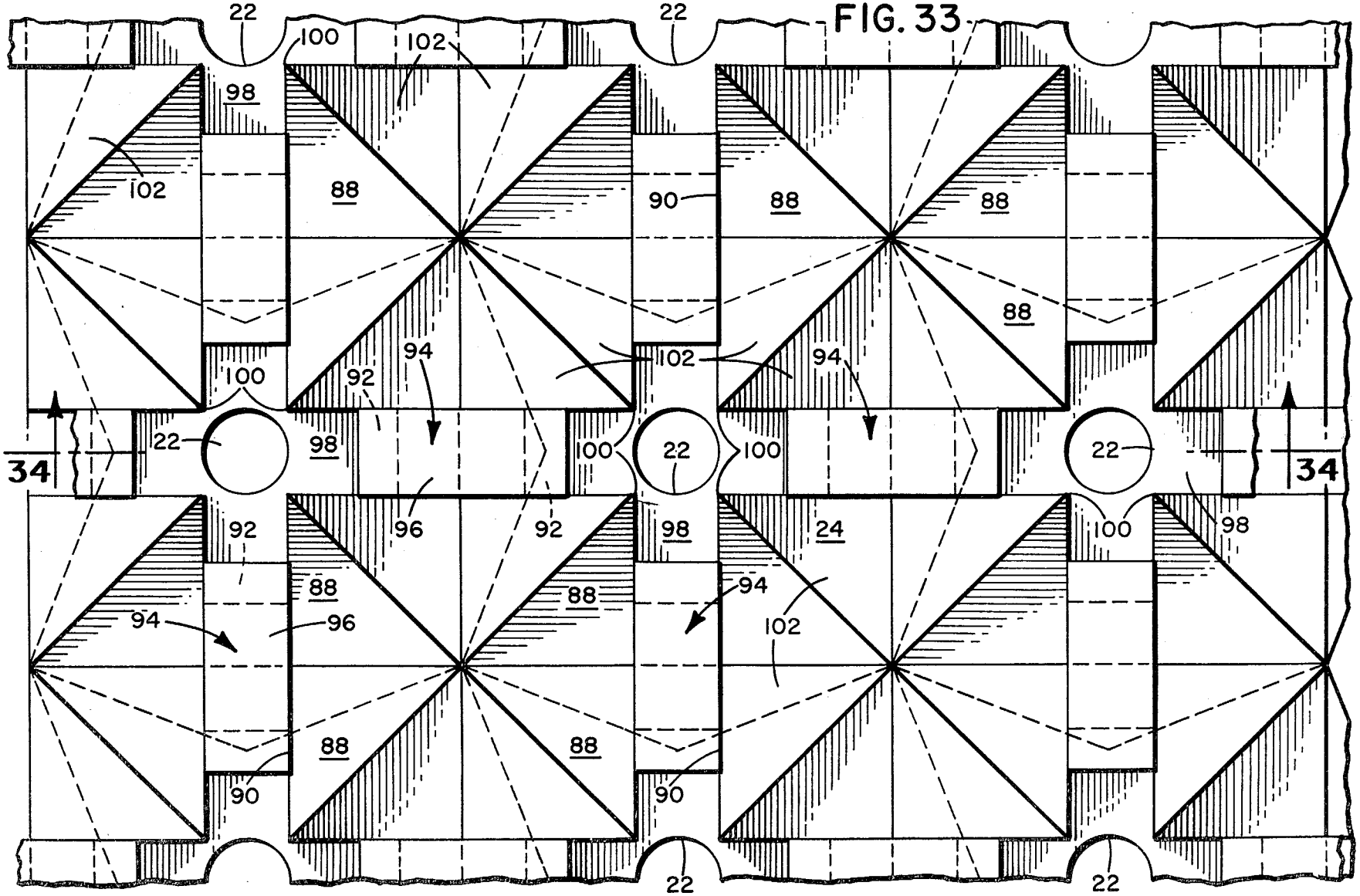
FIG. 33 is a top plan view of an assembly of a number of modified foundation cubes shown in FIGS. 29–31.

A three-dimensional construction employing the cube units 88 is shown in FIGS. 33 and 34. As will be immediately apparent, the structure is very similar to that employing the cube units 16. However, the use of the keys 94 strengthens the interlocking of the foundation cubes.

Modified Base Pad

Figure 35:
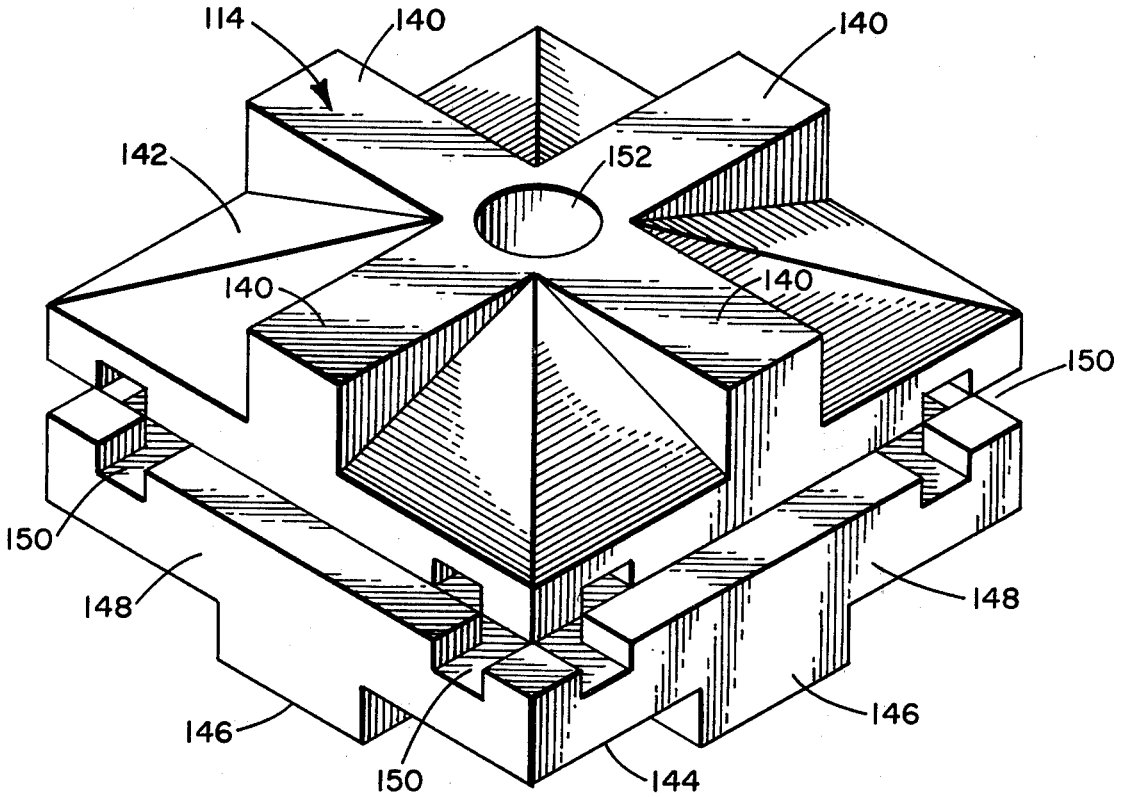
FIG. 35 is a perspective view of a modified base pad.
Figure 28:
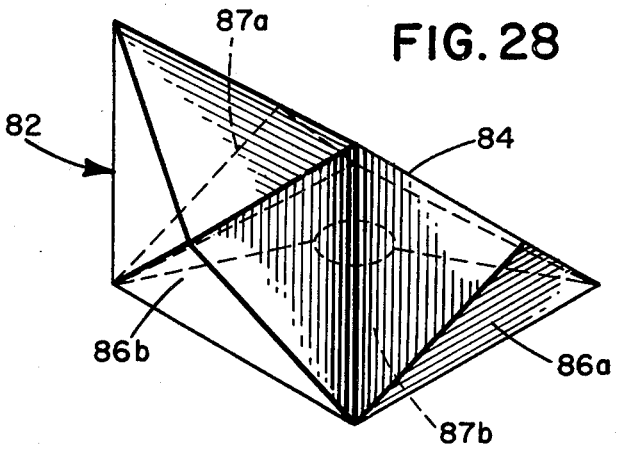
FIG. 28 is a second perspective view of the half-cube unit shown in FIG. 27 looking toward the rear convex face **86*b***.
Figure 36:
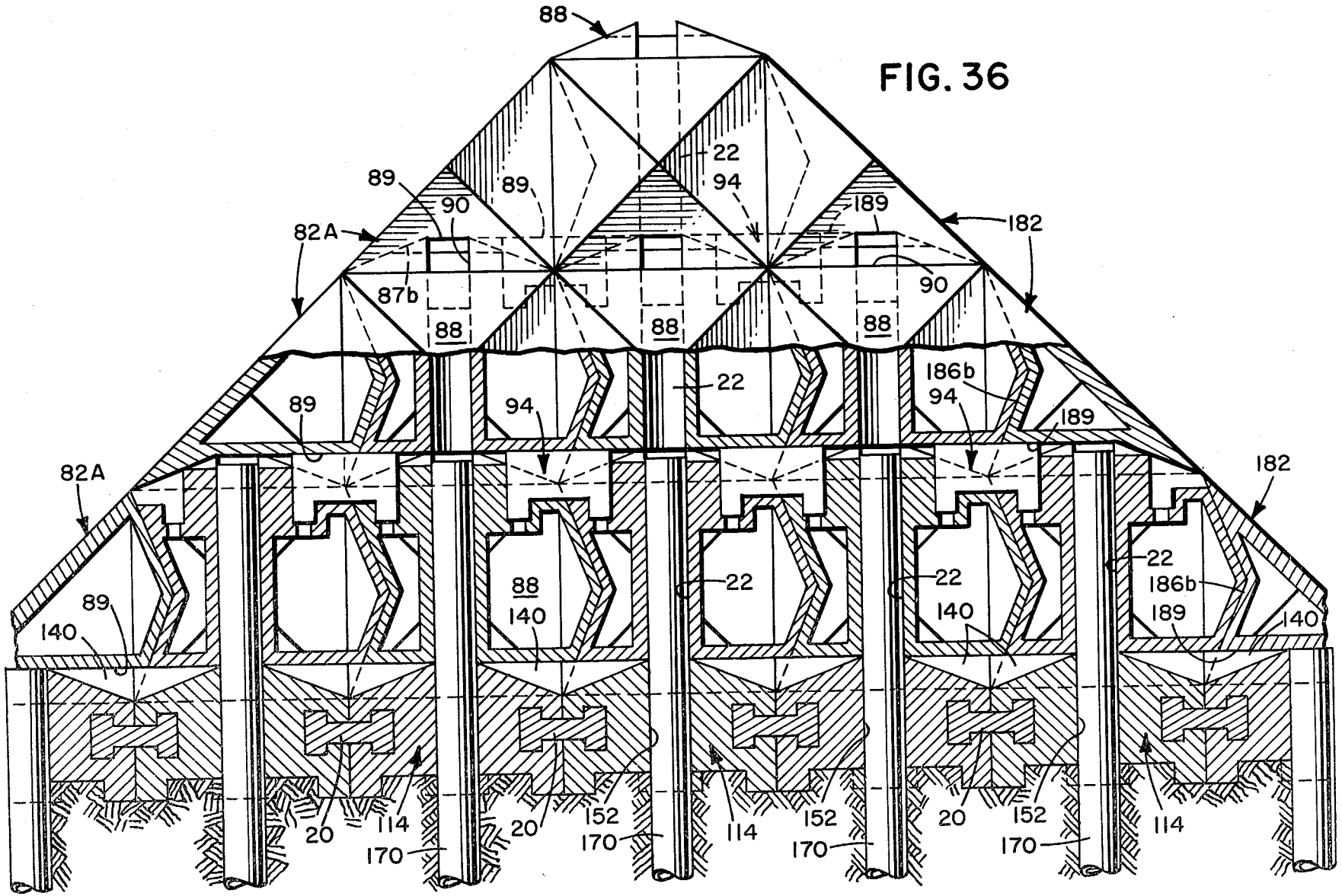
FIG. 36 is a side elevation of a pyramid constructed of the modified foundation cubes and base pads shown in FIGS. 29–35 and half-cubes, with some of the structure shown in section to show piles driven through a first layer of foundation cubes and base pads.

A modified base pad 114 which may be used as an alternative to the base pad 14 as shown in FIG. 35. In this alternative, the concave face 142 is cruciform in shape with the legs 140 of the cross perpendicular to the intermediate sides of the rectahedral parallelepiped. Additionally, the surfaces of the concave face 142, intermediate the legs 140, slope away from the inner vertices of the cross to the peripheral edges of the intermediate sides of the rectahedral parallelepiped, said sloping surfaces being bi-planar. Each planar surface is in the form of a triangle one vertex of which is an inner vertex of the cross, one vertex of which is a corner of the rectahedral parallelepiped, and one vertex of which is the vertex where the adjacent arm of the cross meets an intermediate face of the rectahedral parallelepiped.

Second Alternative Leg Block

Figure 37:
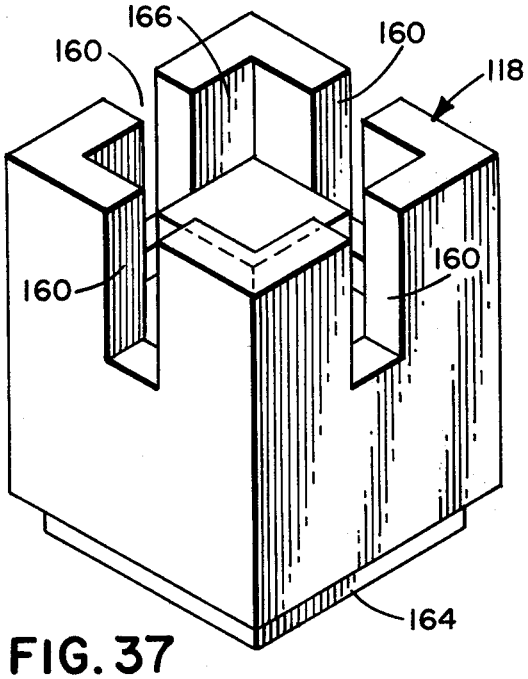
FIG. 37 is an isometric view of a modified leg block.
Figure 38:
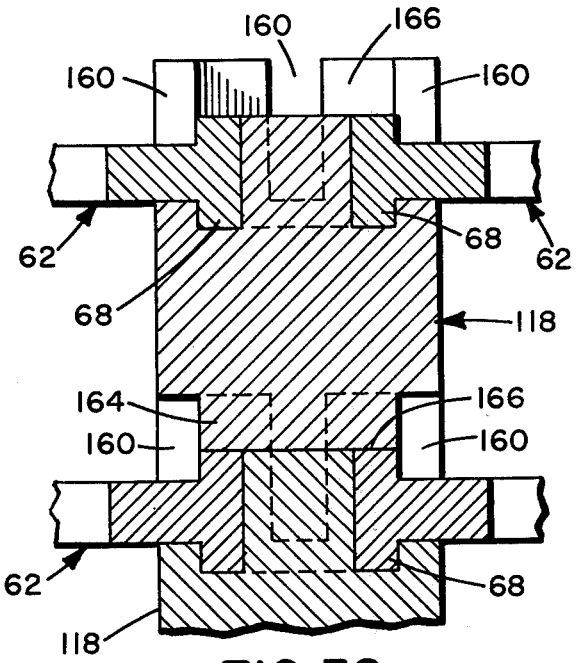
FIG. 38 is a vertical sectional view showing the application of the leg block key of FIG. 20 to the modified leg block of FIG. 37, taken along line 38—38 of FIG. 39.
Figure 39:
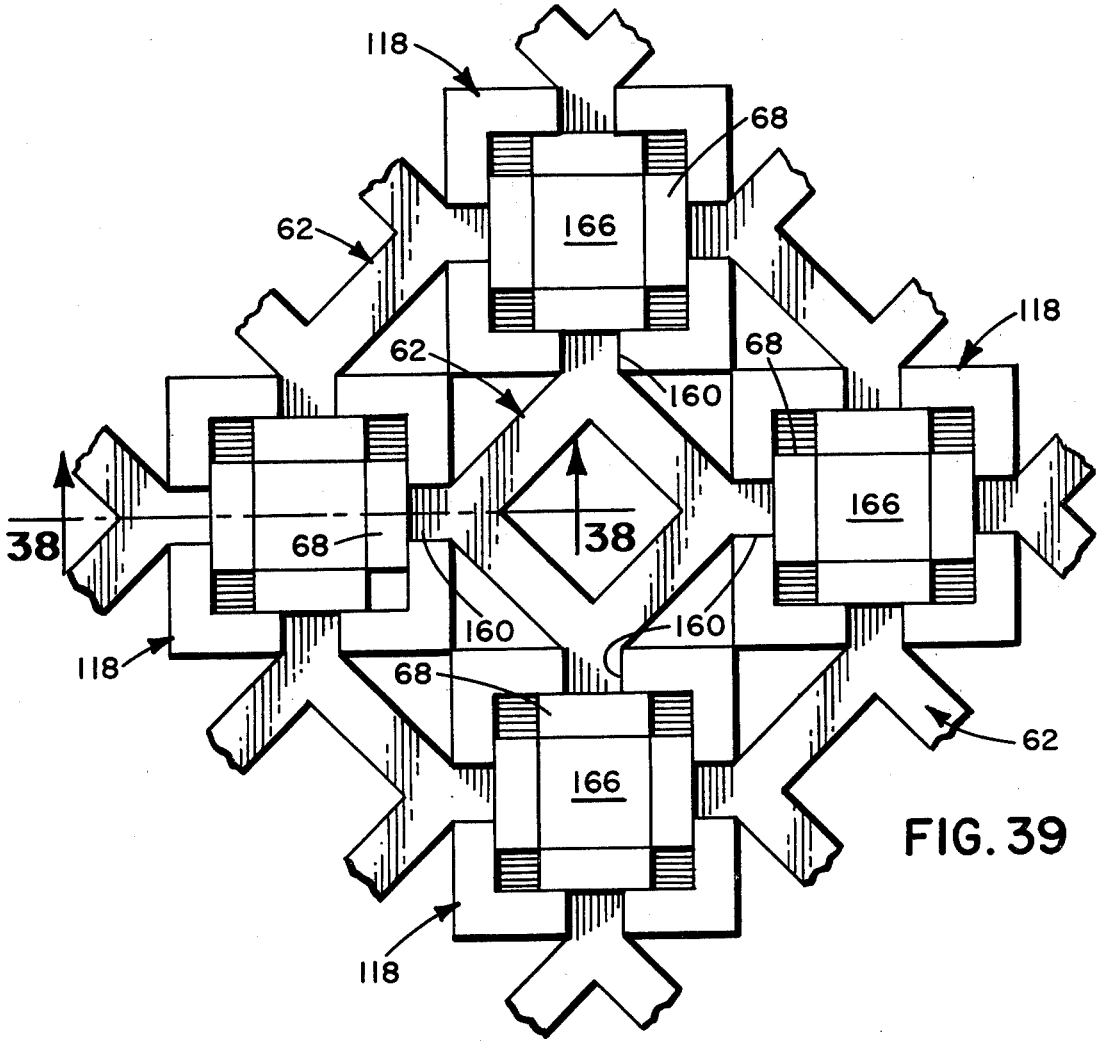
FIG. 39 is a top plan view of four modified leg blocks shown in FIGS. 37, 38 connected by key assembly 62.

A second alternative leg block 118 is shown in FIGS. 37 to 39. In this alternative, the slot 160 opens into the recess 166, and the top of the key 68 forms a part of the bottom of the recess 166 when the leg blocks 118 and the key assemblies 62 are assembled. This shape allows the keys 88 to be lowered into position vertically, rather than horizontally. It also means that the slot 160 is centrally positioned and does not extend the length of each intermediate side, in contrast to the leg block 18, in which the slot 60 must extend the length of each intermediate side in order to allow the keys 68 to be slid into position horizontally.

It is not intended to limit the invention to the details heretofore recited, the invention being defined in the claims which follow.

I claim:

1. An undersea platform construction comprising:

(a) a plurality of foundation blocks, each of said foundation blocks comprising a rectahedral parallelepiped opposite faces of which are concave and convex, respectively, the opposite faces being sized and shaped to interengage matingly, said foundation blocks being interfitted into a three-dimensional array;

(b) a plurality of base pad units supporting said foundation blocks, each of said base pad units comprising a rectahedral parallelepiped one face of which is convex, the opposite face of which has a plurality of protruding lugs, and the intermediate faces of which have T-shaped slots extending the length of each side, said base pad units being interfitted into a two-dimensional array by means of I-shaped keys which fit into adjacent T-shaped slots;

(c) a plurality of leg blocks supporting said base pad units, each of said leg blocks comprising a rectangular parallelepiped one face of which is convex, the opposite face of which is concave, the opposite faces being sized and shaped to interengage matingly, and the intermediate faces of which have T-shaped slots in each side, said plurality of leg blocks being interfitted into a three-dimensional array by means of the mating concave-convex faces in one direction and by means of T-shaped key assemblies to be recited which fit into adjacent T-shaped slots in the other two directions, some of said base pad units interengaging matingly with some of said foundation blocks by means of interengaging, mating convex and concave faces; and (d) a plurality of key assemblies, each of said key assemblies comprising four T-shaped keys symetrically mounted on a planar base, the heads of said T-shaped keys extending perpendicularly to the plane of said planar base and fitting into T-shaped slots in adjacent leg blocks.

2. The platform construction as recited in claim 1 wherein the T-shaped slots of the leg block extend the length of each intermediate side.

3. The platform construction as recited in claim 1 wherein the T-shaped slots of the leg block are centrally positioned and do not extend the length of each intermediate side.

* * * * *